United States Patent [19]

Rous

[11] 3,986,608

[45] Oct. 19, 1976

[54] BOOK CARTON WITH IMPROVED PROTECTIVE END CLOSURE

[75] Inventor: Benjamin Rous, New York, N.Y.

[73] Assignee: Stone Container Corporation, Chicago, Ill.

[22] Filed: Mar. 1, 1976

[21] Appl. No.: 662,963

[52] U.S. Cl. ..... 206/424; 229/34 HW; 229/40

[51] Int. Cl.[2] ..... B65D 85/30

[58] Field of Search ..... 229/40, 34 HW; 206/424, 206/521

[56] References Cited

UNITED STATES PATENTS

| | | | |
|---|---|---|---|
| 3,445,054 | 5/1969 | Champlin | 206/424 X |
| 3,722,783 | 3/1973 | Rous | 229/40 |
| 3,836,066 | 9/1974 | Priore et al. | 206/424 X |

*Primary Examiner*—Stephen P. Garbe
*Attorney, Agent, or Firm*—Darby & Darby

[57] ABSTRACT

Cartons for packaging and mailing books and articles of small thicknesses include parallel top and bottom walls which are foldably interconnected by a pair of parallel side walls to form a tubular structure and a closure and protecting structure for each end of the tubular structure including end flaps having an inner and outer portion. A pair of tabs formed partly in the bottom wall and partly in the inner portion of the end flaps is hingedly connected to the bottom wall of the carton and divided by a score line into an inner portion normally positioned perpendicular to the bottom wall and an outer portion normally positioned parallel to the bottom wall. The width of the tab at the score line is greater than the width of the outer edge of the outer portion of the tab so that the bottom wall end flap maintains the tab inner portion in a perpendicular position against the packaged article.

4 Claims, 7 Drawing Figures

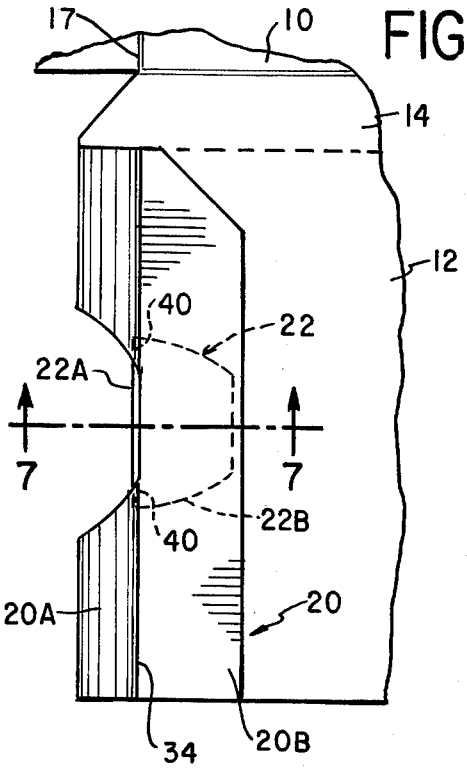
FIG. 6
FIG. 7
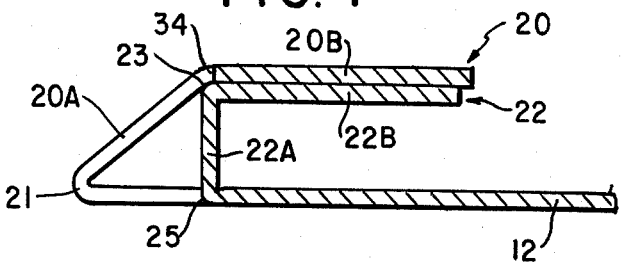

BOOK CARTON WITH IMPROVED PROTECTIVE END CLOSURE

BACKGROUND OF THE DISCLOSURE

This invention generally relates to cartons for packaging books and the like, having triangularly shaped closure flaps which provide protection for the enclosed book.

The present invention is an improvement over the carton disclosed in U.S. Pat. No. 3,722,783, the disclosure of which is hereby incorporated herein. While the carton disclosed in U.S. Pat. No. 3,722,783 has proved satisfactory for packaging books and articles having thicknesses of seven-eighths of an inch or greater, additional apparatus is required to erect and package the cartons for smaller thickness books. An example of such additional apparatus is disclosed in U.S. Pat. No. 3,722,783 with respect to the embodiment illustrated in FIGS. 8–12.

Furthermore, in the carton disclosed in U.S. Pat. No. 3,722,783 for use with small thickness articles which is illustrated in FIGS. 8–12 of the patent, the tabs do not engage the packaged article.

The carton of this invention can be easily erected and packaged with small thickness books using conventional carton-erecting and article-inserting apparatus and without the need for additional apparatus. Furthermore, the carton of this invention provides a triangularly shaped end closure which provides protection for the enclosed book because the tabs directly engage the packaged article and prevent it from slipping into the triangular air bumper.

SUMMARY OF THE INVENTION

The carton of this invention includes rectangularly shaped top and bottom walls interconnected by a trapezoidally shaped side wall. A pair of end flaps is hingedly connected to each end of the top wall. The top wall end flaps include an inner portion and an outer portion. Another pair of end flaps is hingedly connected to the bottom wall along a first fold line. A second fold line separates each of the bottom wall end flaps into an inner and outer portion. A pair of tabs is formed partly in the bottom wall of the carton and partly in the bottom wall end flap inner portions.

Each of the tabs has a flattened elliptical shape and is divided into inner and outer portions by a partly cut score line. Each tab inner portion is normally positioned perpendicular to the bottom wall and each tab outer portion is normally positioned parallel to the bottom wall. The width of the tab at the partly cut score line is greater than the width of the tab at its outer edge. This is an important feature of this invention because, in the erected carton, this feature permits the bottom wall end flap inner portion to hold or maintain the inner portion of the tab in a perpendicular position against the side of the packaged book and provide triangular bumper protection for the ends of the carton. As illustrated in FIG. 12 of U.S. Pat. No. 3,722,783, the tab 33 of the prior art small thickness carton is not held against the packaged article.

Since the widened portion of the tab is greater in width than the cutout portion of the end flap inner portion from which the outer edge of the tab is formed in the erected carton, the inner portion of the tab is maintained in a perpendicular position by the end flap inner portion. If the widened portion of the tab were not as great in width as the cutout portion of the end flap inner portion from which the outer edge of the tab is formed, the inner portion of the tab would fall out of the cutout portion of the inner end flap in the erected carton.

In erecting the carton and inserting the article to be packaged, the carton blank is placed on a conveyor and the tab portions of the bottom wall are raised upwardly. Then, the book is inserted into the carton and the bottom wall end flaps are raised about the first fold line. As the bottom wall end flaps are raised, they engage the raised tabs and cause them to rise further. As the bottom wall end flap outer portions are bent parallel to the bottom wall of the carton, the tab outer portions are also bent to a position parallel to the bottom wall of the carton.

The structural features of the invention and the complete nature thereof will be more apparent following a consideration of the ensuing specification and the appended claims in which the invention is defined, particularly when taken in conjunction with the accompanying illustrative drawings setting forth a preferred embodiment of the invention.

BRIEF DESCRIPTION OF THE DRAWINGS

FIG. 6 is a top plan view of the carton illustrated in FIG. 5 partly broken away; and FIG. 7 is a cross-sectional view of the carton illustrated in FIG. 6 taken along the lines 7—7.

DESCRIPTION OF A PREFERRED EMBODIMENT

Figure 1:
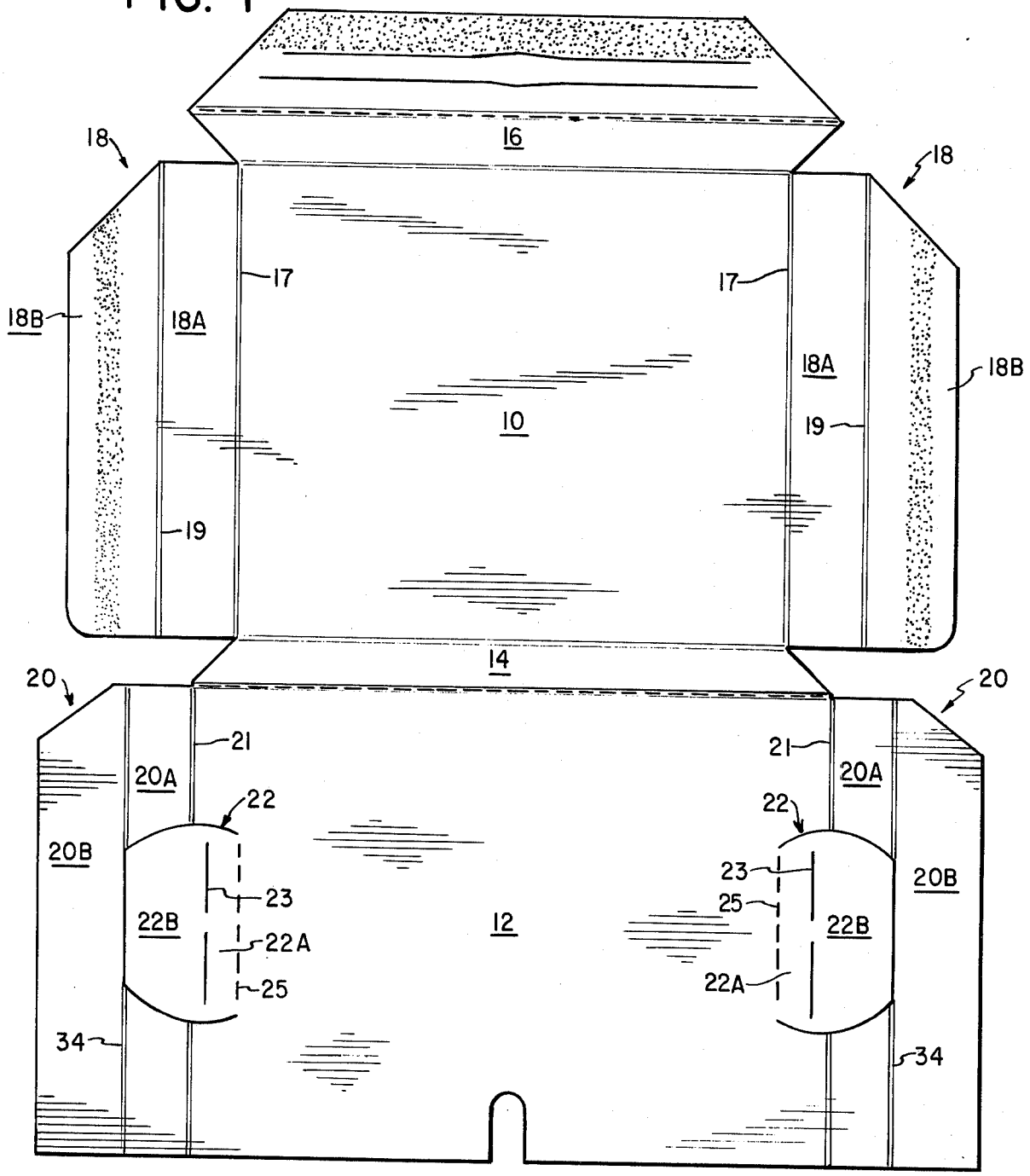
FIG. 1 is a top plan view of an unerected carton illustrating a preferred embodiment of my invention.

Referring to FIG. 1, the carton blank of this invention includes a rectangularly shaped top wall 10 and a rectangularly shaped bottom wall 12 which are foldably interconnected by a trapezoidally shaped side wall 14 and which are normally positioned parallel to one another. Another trapezoidally shaped side wall 16 is foldably connected to top wall 10 and is normally positioned parallel to side wall 14 and perpendicular to top and bottom walls 10 and 12 respectively.

Outer end flaps 18 are foldably connected to each end of top wall 10 along a score line or fold line 17. The end flaps 18 include an inner portion 18A and an outer portion 18B separated by a fold line 19. The end wall inner portion 18A is normally positioned obliquely with respect to top wall 10 and the end wall outer portion 18B is normally positioned parallel to the bottom wall 12. The speckling on the end flap outer portion 18B in the drawings indicates that glue is applied to these surfaces and that they are glued to the outer surface of bottom wall 12.

Inner end flaps 20 are foldably connected to each end of the bottom wall 12 along a first fold line 21. Similar to the outer end flaps 18, the inner end flaps 20 are divided by a second fold line 34 into an inner portion 20A which is normally positioned obliquely with respect to the bottom wall 12 and an outer portion 20B which is normally positioned parallel to the bottom wall 12.

Tabs 22 are formed partly in the bottom wall 12 and partly in the inner portion 20A of each of the inner end flaps. Each of the tabs 22 is divided by a partly cut third score line 23 into an inner portion 22A and an outer portion 22B.

The tab inner portion 22A is normally positioned perpendicular to the bottom wall of the carton and is generally of a height which corresponds to the contents of the carton. The tab outer portion 22B is bent at an angle of approximately 90° over the contents of the carton so that it is normally positioned parallel to the bottom wall 12 of the carton. The tabs, which are generally in the shape of a flattened ellipse, are completely cut out about three sides and are hingedly connected to the bottom wall 12 of the carton along a fourth fold line 25.

For purposes of reference, the edge of the tab 22 coincident with the fourth fold line 25 is referred to as the inner edge of the tab; the portion of the tab coincident with the second fold line 34 is referred to as the outer edge of the tab, and the portion of the tab coincident with the partly cut score line 23 is referred to as the central portion of the tab.

The central portion of the tab 22 is greater in width than the outer edge of the tab 22. This feature of the invention is important in the erected carton because it permits the inner portions 20A of the bottom wall end flaps to maintain the tab inner portions 22A in a perpendicular position against the packaged book or article. Referring to FIG. 6, it is seen that in the erected carton, the central portion of the tab 22 abuts the cutout in the end flap inner portion 20A from which the tab outer edge was formed. This portion of the cutout is generally coincident with the second fold line 34. Thus, it can be seen that if the width of the outer edge of the tab 22 were greater than the width of the central portion of the tab 22, the tab inner portion 22A would not be supported in a perpendicular position, with relation to the bottom wall, by the bottom wall end flap inner portion 20A.

Another important feature of this invention is that the same apparatus used for erecting and packaging carton blanks for large thickness books can be used for erecting and packaging the carton of this invention. Thus, it is not necessary to employ the special mechanical inserts described in U.S. Pat. No. 3,722,783 at column 6, lines 5 et seq. for the packaging of small thickness books. This is made possible because the tab 22 extends into the bottom wall end flap inner portion 20A. This feature of the invention is described below in connection with the carton blank erecting and packing operation illustrated in FIGS. 2–4.

Figure 2:
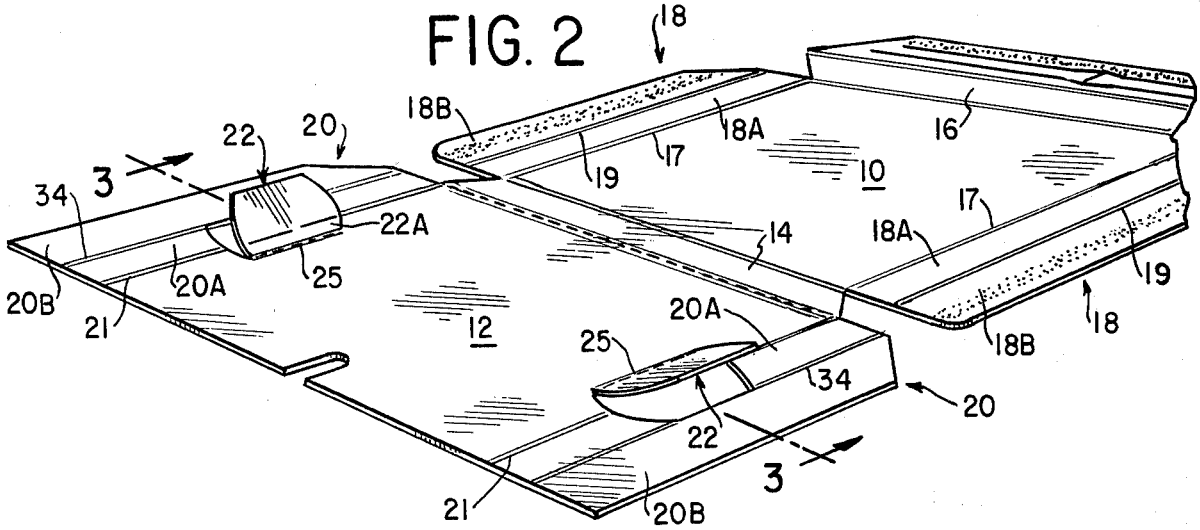
FIG. 2 is a perspective view of a partially erected carton.
Figure 3:
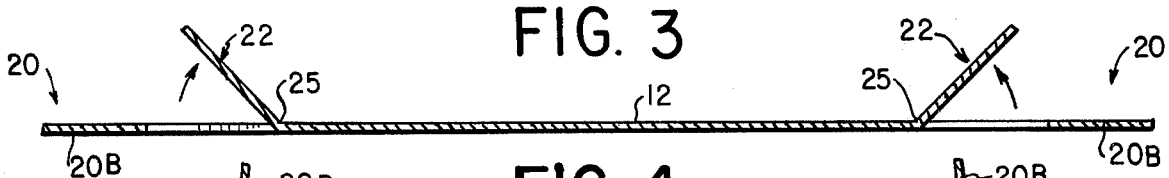
FIG. 3 is a cross-sectional view of the carton illustrated in FIG. 2 taken along the lines 3—3.
Figure 4:
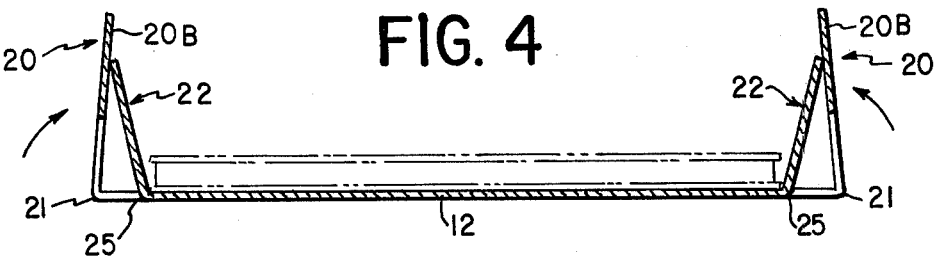
FIG. 4 is a view similar to FIG. 3 showing the carton illustrated in FIG. 2 in a partially erected form.

Referring to FIGS. 2 and 3, the carton blank is first placed on the conveyor in a substantially flat position. As the flat carton blank proceeds along the conveyor, the tabs 22 are pushed upwardly so as to form an angle with the bottom wall of the carton. As the carton blank progresses further along the conveyor, conventional plows engage the bottom wall end flaps 20 and rotate them upwardly about the score line 21. As the bottom wall end flaps are rotated upwardly, they engage the tabs 22 and rotate them upwardly about score line 25, as illustrated in FIG. 4.

Figure 5:
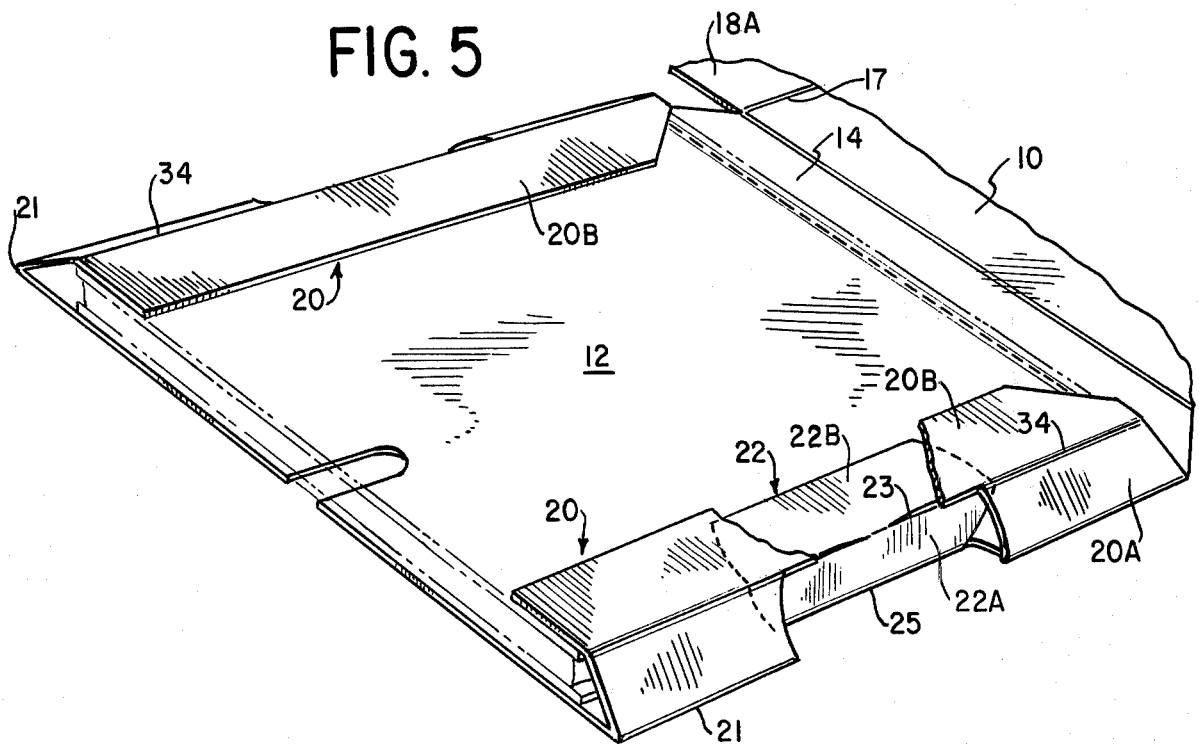
FIG. 5 is a perspective view of the carton illustrated in FIG. 2 in a partially erected form.

The bottom wall end flap outer portion 20B is then folded over to a substantially horizontal position so that it is parallel to the bottom wall. As the end flap outer portion 20B is being folded, it engages the tab outer portion 22B and causes the tab outer portion to bend to a substantially horizontal position about score line 23 so that the tab outer portion 22B underlies the end flap outer portion 20B, as illustrated in FIGS. 5, 6 and 7.

While an embodiment of various aspects of the invention has been shown in the drawings, it is to be understood that this disclosure is for the purpose of illustration and that various changes in shape and proportion and arrangement of parts, as well as the substitution of equivalents for those herein shown and described, may be made without departing from the spirit and scope of the invention as set forth in the appended claims. For example, the tab outer portion 22B may be in the shape of a trapezoid rather than a flattened elliptical shape.

What is claimed is:

1. In a carton for packaging an article comprising a rectangularly shaped top wall, a rectangularly shaped bottom wall, a pair of trapezoidally shaped side walls foldably connected to each side of said top wall, one of said pair of side walls also being foldably connected to one side of said bottom wall, a first pair of end flaps, each of said first end flaps being foldably connected to one end of said bottom wall along a first fold line, each of said first end flaps including an inner portion and an outer portion, a pair of tabs being formed from a cutout portion of said bottom wall and said first end flap inner portion, each of said pair of tabs being foldably connected to said bottom wall along a second fold line, said second fold line being spaced inwardly with respect to said bottom wall from said first fold line, said first end flap inner portion being foldably connected to said first end flap outer portion along a third fold line, said end flap inner portion being foldably connected to said bottom wall, the improvement comprising, each of said tabs being divided into an inner portion and an outer portion by a fourth fold line such that the inner edge of each said tab inner portion is foldably connected to said bottom wall along said second fold line and the outer edge of said tab outer portion is cut out from said first end flap inner portion, said tab portion coincident with said fourth fold line being greater in width than said tab outer edge.

2. The improvement recited in claim 1, said tab inner portion being normally positioned perpendicular to said bottom wall, said tab outer portion being normally positioned parallel to said bottom wall, said first end flap inner portion being normally positioned obliquely with respect to said bottom wall and said first end flap outer portion being normally positioned parallel to said bottom wall and overlying said tab outer portion.

3. The improvement recited in claim 1, said fourth fold line being spaced inwardly with respect to said bottom wall from said first fold line.

4. The improvement recited in claim 1, said tab outer edge being coincident with said third fold line.

* * * * *